US009572427B2

(12) United States Patent
Klooth

(10) Patent No.: US 9,572,427 B2
(45) Date of Patent: Feb. 21, 2017

(54) MOTORIZED HOME STORAGE SYSTEM

(71) Applicant: LFK Engineering LLC, Thousand Oaks, CA (US)

(72) Inventor: Lutz Friedrich Klooth, Thousand Oaks, CA (US)

(73) Assignee: LFK ENGINEERING LLC, Thousand Oaks, CA (US)

( * ) Notice: Subject to any disclaimer, the term of this patent is extended or adjusted under 35 U.S.C. 154(b) by 0 days.

(21) Appl. No.: 14/231,389

(22) Filed: Mar. 31, 2014

(65) Prior Publication Data

US 2015/0272323 A1 Oct. 1, 2015

(51) Int. Cl.
*A47B 51/00* (2006.01)
*A47B 5/00* (2006.01)

(52) U.S. Cl.
CPC ..... *A47B 51/00* (2013.01); *A47B 2005/003* (2013.01); *A47B 2051/005* (2013.01)

(58) Field of Classification Search
CPC ... A47B 51/00; A47B 2051/005; A47B 96/06; A47B 96/067; A47B 96/07; A47B 46/00; A47B 46/005; B66B 11/08; B66B 11/008
See application file for complete search history.

(56) References Cited

U.S. PATENT DOCUMENTS 1,090,837 A * 3/1914 Clarke ..... 211/117
3,081,884 A * 3/1963 Minty ..... 212/274
3,565,217 A * 2/1971 St. Louis ..... 187/256
3,866,718 A * 2/1975 Hiergeist ..... 187/262
4,214,664 A * 7/1980 Polen ..... 212/274
4,324,386 A * 4/1982 Gagnon et al. ..... 254/288
4,705,180 A * 11/1987 Lamer et al. ..... 212/307
4,827,667 A * 5/1989 Jarvis ..... 49/280
5,167,401 A * 12/1992 James et al. ..... 254/292
5,672,847 A * 9/1997 Piatt ..... 174/135
5,871,070 A * 2/1999 Contreras ..... 187/263
5,979,671 A * 11/1999 Pan et al. ..... 211/1.57
6,584,642 B2 * 7/2003 Hodson ..... 16/85
6,883,579 B2 * 4/2005 Olmsted ..... 160/189
(Continued)

OTHER PUBLICATIONS

The Garage Gator, Installation Manual and Product Information, www.garagegator.com.

(Continued)

*Primary Examiner* — Katherine Mitchell
*Assistant Examiner* — Shiref Mekhaeil
(74) *Attorney, Agent, or Firm* — Koppel, Patrick, Heybl & Philpott

(57) ABSTRACT

A motorized home storage system can be mounted to any type of ceiling for storing items off the ground. The motorized home storage system is designed to make use of unused ceiling space, allowing homeowners to store their items overhead and out of the way and create additional storage in homes. The system is designed for large and heavy items that can be easily stored due to the two tube motors. Tube motors can allow a storage platform to be lowered for easy access, loading, and unloading. Additionally, tube motors can allow the storage platform to be raised to the ceiling in order to be completely out of the way and off the ground. The system can include legs attached to the platform which can unsnap to turn the platform into a table.

17 Claims, 8 Drawing Sheets

2 Device
10 Shelf frame
11 Platform (wire, wood, metal-deck)
12, 13, 14 Shelf support beam
15, 16, 17, 18 Rope Bender
19, 20, 21, 22 Rope clip
23, 24 Montage Rail
25, 26 Steel Rope
27, 28 Tube motor
29, 30, 31, 32, 33, 34, 35, 36 Rope holder
40, 41, 42, 43 Motor brackets

(56) References Cited

U.S. PATENT DOCUMENTS

| | | | | |
|---|---|---|---|---|
| 6,991,064 | B2 * | 1/2006 | Ehrenleitner | 182/141 |
| 7,243,870 | B2 * | 7/2007 | Pook et al. | 242/278 |
| 7,284,744 | B1 * | 10/2007 | Lerchenmueller et al. | 254/278 |
| 7,416,055 | B2 * | 8/2008 | Penn et al. | 182/141 |
| 7,575,098 | B2 * | 8/2009 | Hartley | 187/262 |
| 7,975,987 | B2 * | 7/2011 | Shin | 254/278 |
| 8,511,486 | B2 * | 8/2013 | Mansor | 211/117 |
| 2003/0111651 | A1 * | 6/2003 | Volle et al. | 254/278 |
| 2006/0238085 | A1 * | 10/2006 | Greenberg | 312/306 |
| 2007/0245518 | A1 * | 10/2007 | Blair | 16/85 |
| 2008/0289264 | A1 * | 11/2008 | Bowman | 52/29 |
| 2009/0179538 | A1 * | 7/2009 | Greenberg | 312/237 |
| 2010/0096353 | A1 * | 4/2010 | Cho | 212/330 |
| 2010/0102104 | A1 * | 4/2010 | Tanimoto et al. | 227/146 |
| 2010/0133046 | A1 * | 6/2010 | Allwardt et al. | 187/251 |
| 2012/0000865 | A1 * | 1/2012 | Cangialosi | 211/1.57 |
| 2012/0184401 | A1 * | 7/2012 | Shepherd et al. | 473/481 |
| 2012/0248046 | A1 * | 10/2012 | Warner | 211/1.57 |
| 2013/0126809 | A1 * | 5/2013 | Britten et al. | 254/385 |
| 2013/0185969 | A1 * | 7/2013 | Britten et al. | 40/584 |
| 2014/0116968 | A1 * | 5/2014 | Krohn | 211/1.51 |
| 2014/0175353 | A1 * | 6/2014 | Hoffend et al. | 254/376 |
| 2014/0252930 | A1 * | 9/2014 | Reid et al. | 312/247 |

OTHER PUBLICATIONS

Power Rax Product Information, www.powerrax.com.
Unique 1 Storage Life, Installation Manual and Product information, www.unique1lift.com.

* cited by examiner

2 Device
10 Shelf frame
11 Platform (wire, wood, metal-deck)
12, 13, 14 Shelf support beam
15, 16, 17, 18 Rope Bender
19, 20, 21, 22 Rope clip
23, 24 Montage Rail
25, 26 Steel Rope
27, 28 Tube motor
29, 30, 31, 32, 33, 34, 35, 36 Rope holder
40, 41, 42, 43 Motor brackets 10 Shelf frame
23, 24 Montage rail
27, 28 Tube motor
40, 41, 42, 43 Motor Brackets Figura2 Motor OUTSIDE version
Figure3 Motor INSIDE version
Figure4 Motor UP version
Figure5 Motor DOWN version 15, 16 Rope bender
19, 20 Wire rope clips
23, 24 Montage rail
25 Wire rope
27 Tube motor
29, 30, 33, 34 Rope holder
37 Set Screw
40, 41 Motor brackets 15 Rope Bender
25 Steel Rope
50 Leg
51 Spring
53 Switch point E-Motor
54 Bumper
55, 56 Screw
57 Channel
58 Pin
59 Suspension 10 Shelf frame
15, 16 Rope Bender
19, 20 Rope clip
23, 24 Montage rails
25, 26 Steel rope
27, 28 Tube motor
40, 41, 43 Motor brackets 60 Switch (up)
61 Switch (down)
62 Adjustable End- Switches Up
63 Adjustable End- Switches Down
64 Motor left turn (up)
65 Motor right turn (down)
66 Temperature switch
67 Voltage measurement
68 Tube motor 1 Screw 3 ½" X 3/8" ASME B18.2.1
2 Strut channel 1 5/8" X 1 5/8"
3 Screw 10-9 #2 drive
4 Motor controller

MOTORIZED HOME STORAGE SYSTEM

BACKGROUND OF THE INVENTION

Field of the Invention

The invention relates to motorized home storage products, and specifically to overhead storage products.

Description of the Related Art

Storage areas of a building typically include items stacked in floor space. Recently, however, storage structures supported from a ceiling have increased storage capacity by permitting items to be placed well above the floor, near the ceiling area of a room. These products sometimes require walking up or down a ladder to retrieve products, which can be dangerous. Further, many retrievable storage platform options are very time-consuming to build and/or install, and can be very expensive. Finally, these designs can be visually unappealing and can be unsafe due to countless moving parts and cables, with various parts sticking out of the main body of the product.

SUMMARY OF THE INVENTION

One embodiment of an overhead storage device according to the present invention can include left and right tube motors and a platform. A left cable can connect the left tube motor to the platform while a right cable can connect the right tube motor to the platform.

Another embodiment of an overhead storage device according to the present invention can include a cable and a platform, with a suspension below the platform.

One device according to the present invention can include first and second motors, and an electrical circuit for controlling the motors that is configured to stop one of the motors upon the stoppage of the other of the motors.

These and other aspects and advantages of the invention will become apparent to those skilled in the art from the following detailed description and the accompanying drawings, which illustrate by way of example the features of the invention.

DETAILED DESCRIPTION OF THE INVENTION

The present invention is directed to different embodiments of motorized overhead storage systems. Some embodiments of systems according to the present invention can include one or more tube motors. One embodiment, for example, includes two tube motors, each with a corresponding cable that can connect the tube motor to a storage platform in one or more places. The tube motors can raise and lower the platform. The cables can wrap or coil around the tube motors such that the cables always wrap in a single direction, which helps to prevent platform unevenness and can prevent cable overlapping and/or rubbing, which can cause deterioration or breakage. Systems according to the present invention can include circuitry that can be configured to cause two or more motors to stop near simultaneously such that the platform does not become uneven. Systems according to the present invention can also include one or more suspension systems, such as below the platform.

It is understood that when an element is referred to as being "on" another element, it can be directly on the other element or intervening elements may also be present. Furthermore, relative terms such as "inner", "outer", "upper", "above", "lower", "beneath", "below", "left", "right", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

Embodiments of the invention are described herein with reference to illustrations that are schematic in nature. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 1:
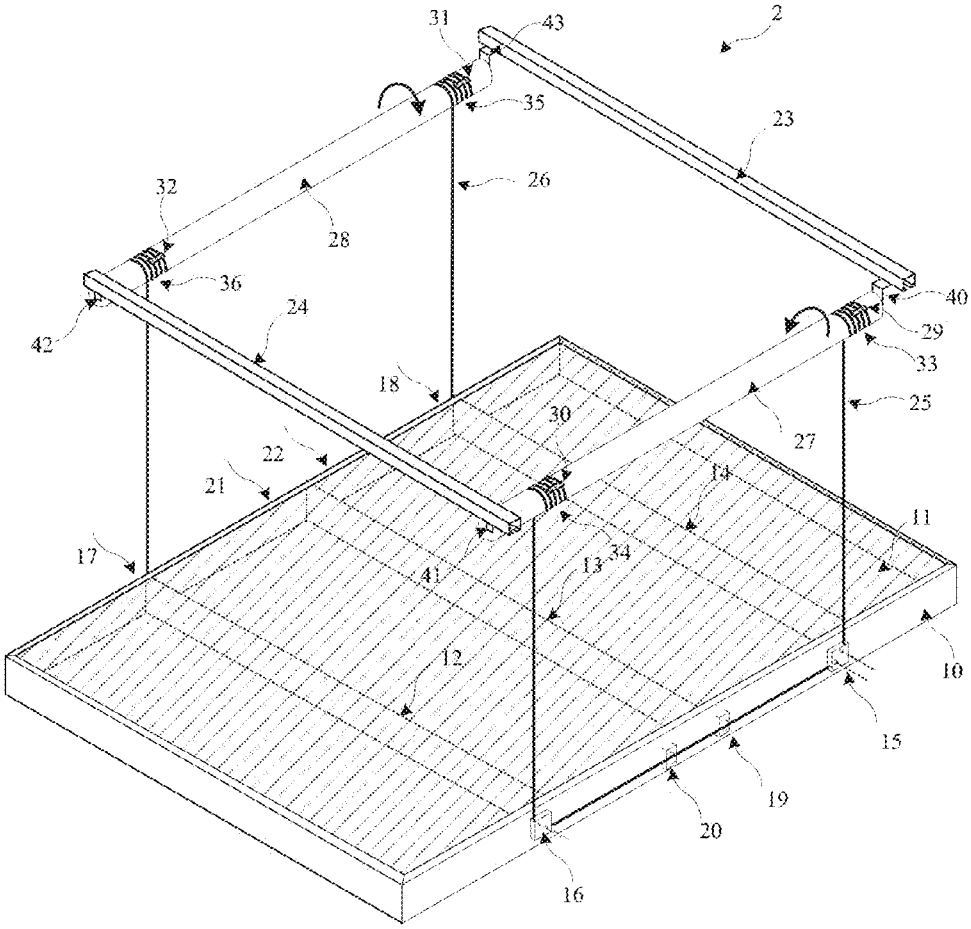
FIG. 1 is a perspective view of a storage system according to one embodiment the present invention.

FIG. 1 shows a motorized home storage system 2 according to one embodiment of the present invention. The system 2 can be mounted to any type of ceiling and can be used for storing items off the ground. The system 2 is designed to make use of unused ceiling space, allowing homeowners and/or business owners to store items overhead and out of the way, thus creating additional space on the floor. Some embodiments can accommodate large and heavy items.

The system two can include left and right montage rails 23,24 that can be mounted to a ceiling, such as with screws or other connection devices known in the art. The system can also include one or more tube motors; in the embodiment shown, the system 2 includes two tube motors 27,28, which can be attached to the montage rails 23,24, such as by motor brackets 40,41,42,43. The system can include two or more cable-type devices; in the embodiment shown, the system 2 includes two cables 25,26, which can be steel, for example. While the term "cable" is used herein, it is understood that in different embodiments many different rope-type structures can be used. The cables 25,26 can be designed to coil around the tube motors 27,28, as will be described in detail below. The system 2 can include a storage platform, which can comprise a shelf frame 10, one or more shelf beams 12,13,14, and a platform 11. Cable benders 15,16,17,18 can be included to shape the cables 25,26 appropriately, and cable clips 19,20,21,22 can be included to further secure the cables 25,26. The cable clips 19,20,21,22 can allow for easy installation and adjustment of the evenness of the platform. Once the cable clips 19,20,21,22 are secured the cable will not slide, ensuring that the platform hangs horizontally.

The use of one or more tube motors can have distinct advantages over prior art systems not comprising tube motors. For example, systems according to the present invention do not necessarily have to include drive shafts, pulleys, pulley mounts, etc. As another example of saving parts, connectors to install a motor to a ceiling joist or other part of the product are unnecessary. A single tube can replace two pulleys. Further, the use of tube motors is space-efficient, since other components may not be present outside the tubes such as a motor, reducing the ceiling storage space and/or not allowing side-by-side installation. Instead, a motor can be placed inside a tube that may have been hollow in the first place. Using two tubes, each with a corresponding cable, can also eliminate the need for a cable crossing from one tube to another (or from one tube through a set of pulleys); this crossing cable can eliminate ceiling storage space in prior art systems. Further, with a system requiring crossing cables, any pulley or tube will often be on the inside of the platform perimeter, reducing the storage space.

Another advantage of tube motors is that these motors can have a circumference that allows for the use of strong cables. In some embodiments of the present invention, a tube motor has about 1.5" or more of diameter for every 1/16" of cable diameter, although other embodiments are possible. Some exemplary embodiments include a tube motor with a 4.5" diameter used with a 3/16" rope and a 3" tube motor used with a 1/8" rope, although many different embodiments are possible. A small pulley or a rod having a small circumference may not work with strong cables, as the cable would bend too much around the small circumference and cause excessive strain or breakage. The tube motors can thus function both as the power device and as a wrapping device for strong cables. Strong cables may be necessary for lifting heavier loads. Many different types of cables, ropes, and/or other similar devices can be used in embodiments of the present invention, some of which are described in the McMaster-Carr® Document 8912TAC Wire Rope Guidelines, ©2007, which is fully incorporated by reference herein. One example is the 7×19 1/8" rope or 3/16" rope; many different embodiments are possible.

Another advantage is that the use of tube motors can allow the distance the platform is to be lowered to be preset, which can lower the amount of tolerance needed from other elements such as springs. For example, upon the platform reaching the ground, the tube motor will stop winding cable automatically due to the presence of a preset cable length.

The use of two tube motors, as opposed to a single tube motor, is approximately the same cost yet typically provides more power. Further, the use of one tube motor can result in a less stable overall structure. Finally, the use of two tube motors allows for items to be raised all the way to the ceiling without the tube motors getting in the way; if only a single tube motor is used, a platform with stored items on it may only reach the bottom of the motor as opposed to the ceiling itself. Two tube motors, however, allows for the tubes to be placed outside the perimeter of the storage area, maximizing the storage capacity. Another advantage of the two tube motors is that suspending the platform from two axes (the tube motors 27,28) allows for a much more stable product which can be loaded mid-air, as opposed to a platform suspended form a single axis which may swing more than desired. With two axes the platform can be unevenly loaded yet remain horizontal, whereas if a platform suspended from a single axis is unevenly loaded the platform may tilt. Suspending a platform from one axis usually requires one cable on each axis end which splits into two cables, which are slanted to reach the platform's corners. If a platform that is longer than the axis is desired (e.g., the platform 11 is longer than the tube motors 27,28), then the slanted cables will occupy potential storage space. To prevent this, the axial motor would need to be as long as the platform itself, which could require a much longer, heavier, and more expensive motor. Finally, two tube motors can also be lighter than regular motors with the same power, which among other things can make the installation easier.

The montage rails 23,24 can have a C-shaped cross-section with the open end on the bottom, for example. Further, the open end of the C-shape can be only partially open, or completely open. The montage rails 23,24 can be mounted to any type of ceiling (e.g. wood, concrete, drywall, etc.) in any number of manners known in the art. Tube motors 27,28 can be connected to the rails 23,24 by brackets 40,41,42,43, which can be L-shaped. One of the brackets 40,41,42,43 can be on each side of the tube motors 27,28.

Cables 25,26 can be connected to the tube motors 27,28 by holders 29,30,31,32,33,34,35,36, although other connectors are possible. The holders can be L-shaped, or many other shapes. The holders can be on the top, bottom, or both of the tube motors 27,28 (in the embodiment shown, the holders are on both top and bottom). While the embodiment shown uses eight holders, fewer or more holders are possible, such as four holders. Each holder can include, for example, three holes, such as two holes through which a cable can pass and one hole for connection to a means for attaching the holder to the tube motor.

Figure 6:
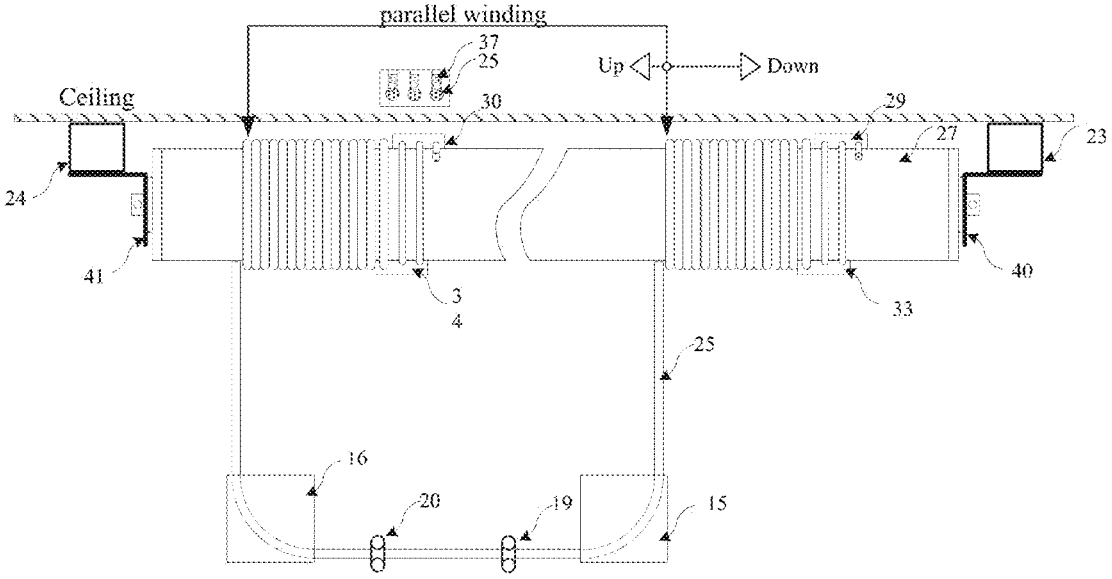
FIG. 6 is a detailed side elevation view of a portion of a storage system according to one embodiment of the present invention.
Figure 7:
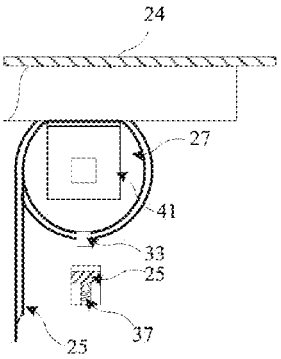
FIG. 7 is a detailed front elevation view of the portion of a storage system shown in FIG. 6.

The cables 25,26 can coil around the tube motors 27,28 at a total of four different places (two per cable). The cables 25,26 can coil such that each coiling area coils in the same direction, such as from left to right or right to left. For example, in FIG. 1 the tube motors 27,28 turn in the direction of the arrows when unwinding, and turn in the opposite direction when winding. In this and some other embodiments, the tube motors can turn opposite one another (e.g. when one turns clockwise, the other turns clockwise), although other embodiments where the tubes turn in the same direction are possible. In the FIG. 1 embodiment, the cables 25,26 will coil toward the montage rail 24, and will retreat toward the montage rail 23 when uncoiling. Having the cables coil in the same direction can ensure that the cables 25,26 remain vertical, as opposed to slanting outward or slanting inward off-vertical. The top of the cables 25,26 can remain the same distance from one another such that the cables are always parallel. A magnified view of this concept is shown in FIGS. 6 and 7. In FIG. 6, as the platform is moved upward, the cables 27,28 coil from left to right, whereas as the platform is moved downward, the cables 27,28 uncoil from right to left. This prevents the cable from overlapping itself, which may cause platform unevenness. It further prevents or reduces cable-on-cable rubbing, which can weaken the cable and/or cause breakage. In other embodiments, the wraps can coil toward the center (and thus toward one another) or toward the outside (and thus away from one another), which may result in the cables slanting inward or outward, respectively.

Cable benders can be used, and can enable the use of fewer cables. For example, four cable benders 15,16,17,18 can be attached to the shelf frame 10, for example, and the cables 25,26 can be shaped by the benders so as to be attached to the tube motors 27,28 at a total of four different points. The four points can approximate the corners of the system 2, or can be inward of the corners as shown. In one embodiment the inside radius of the benders 15,16,17,18 is about two inches, which can provide for smooth bending of the cables 25,26 so as to lower the chance of breakage. By including two benders 15,16,17,18 on each side of the system 2, the cables 25,26 can be prevented from moving and/or sliding, other than the upward/downward movement due to coiling. The clips 19,20,21,22 can also enable the frame 10 and platform 11 to remain horizontal since they can prevent the cables from coiling more on one side of a tube motor than the other.

Figure 2:
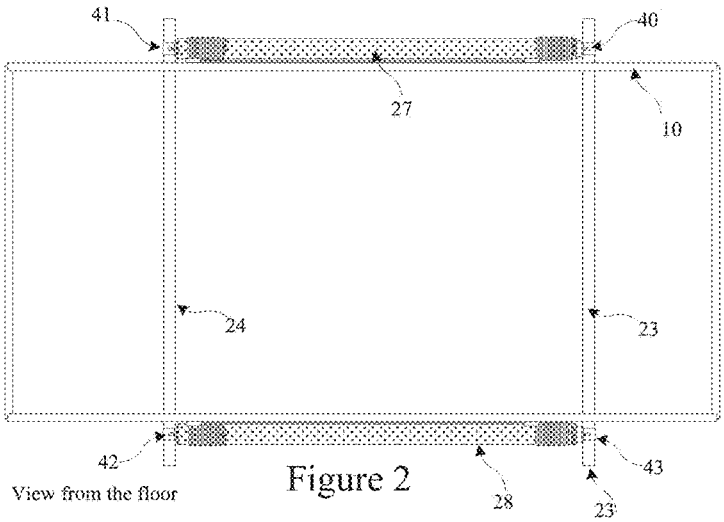
FIG. 2 is a bottom elevation view of a storage system according to one embodiment of the present invention.
Figure 3:
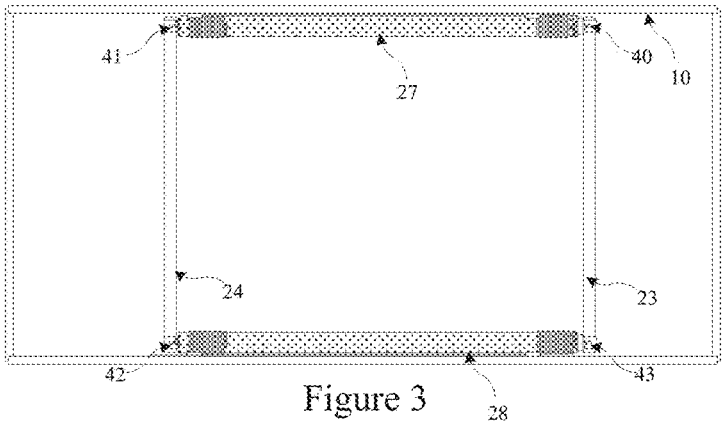
FIG. 3 is a bottom elevation view of a storage system according to one embodiment of the present invention.
Figure 4:
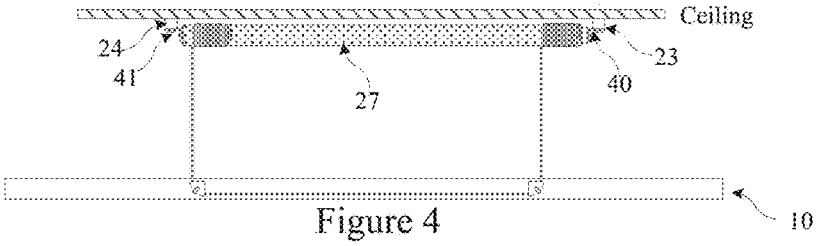
FIG. 4 is a side elevation view of a storage system according to one embodiment of the present invention.
Figure 5:
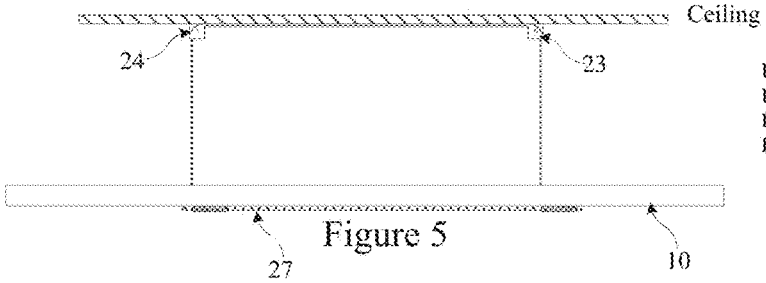
FIG. 5 is a side elevation view of a storage system according to one embodiment of the present invention.
Figure 12:
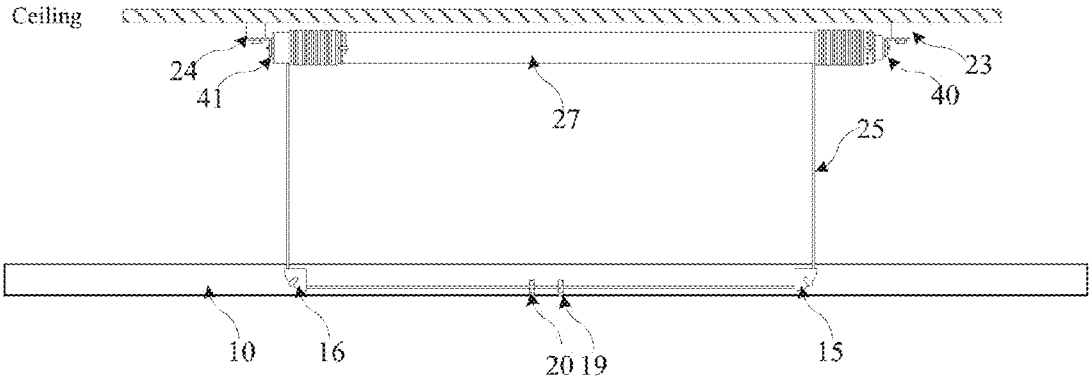
FIG. 12 is a side elevation view of a storage system according to one embodiment of the present invention.
Figure 13:
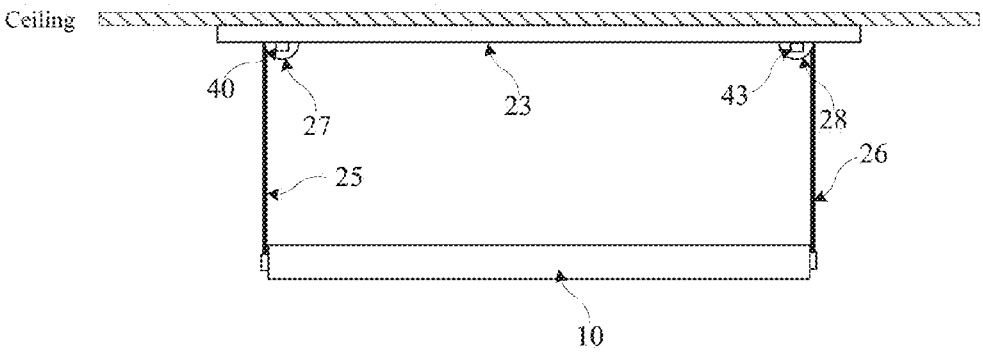
FIG. 13 is a front elevation view of the storage system shown in FIG. 12.

The tube motors 27,28 can be placed in various positions in different embodiments of the present invention. For example, in FIG. 2 the tube motors 27,28 are to the outside of the perimeter of the frame 10, whereas in FIG. 3 the tube motors 27,28 are inside the perimeter of the frame 10. The FIG. 2 embodiment may allow the frame 10 to be raised closer to the ceiling and/or may allow items to be stored higher on the platform, while the FIG. 3 embodiment may allow for a smaller overall footprint. In the embodiment shown in FIG. 4, the tube motors 27,28 can be attached to the ceiling. However, other embodiments are possible, such as that shown in FIG. 5, where the tube motors 27,28 can be attached to the frame 10 or storage platform 11 for example, such as below the storage platform 11, although other embodiments are possible. This can allow the frame platform 11 to be raised closer to the ceiling. FIGS. 12 and 13 show detailed views of embodiments similar to FIGS. 4 and 5, respectively.

Figure 8:
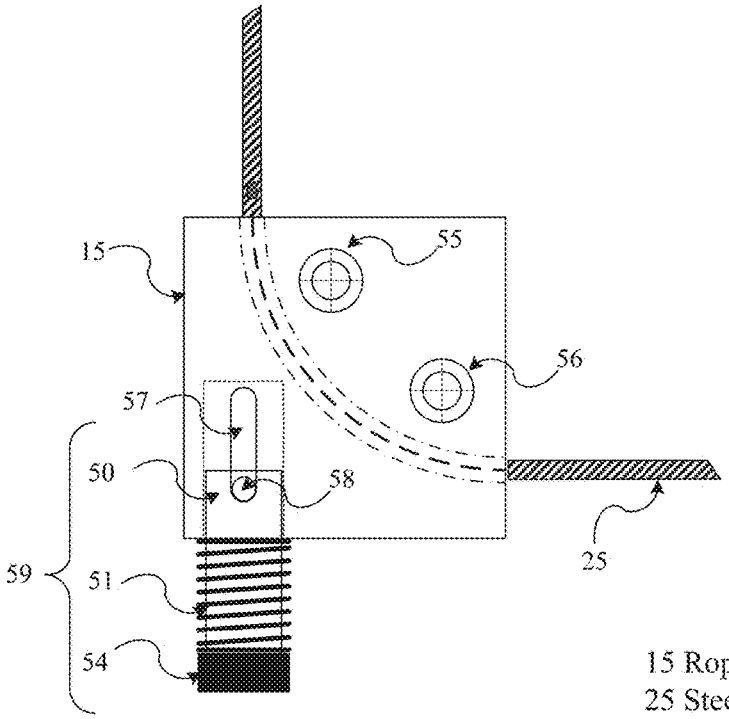
FIG. 8 is a detailed side elevation view of a portion of a storage system according to one embodiment of the present invention.
Figure 9:
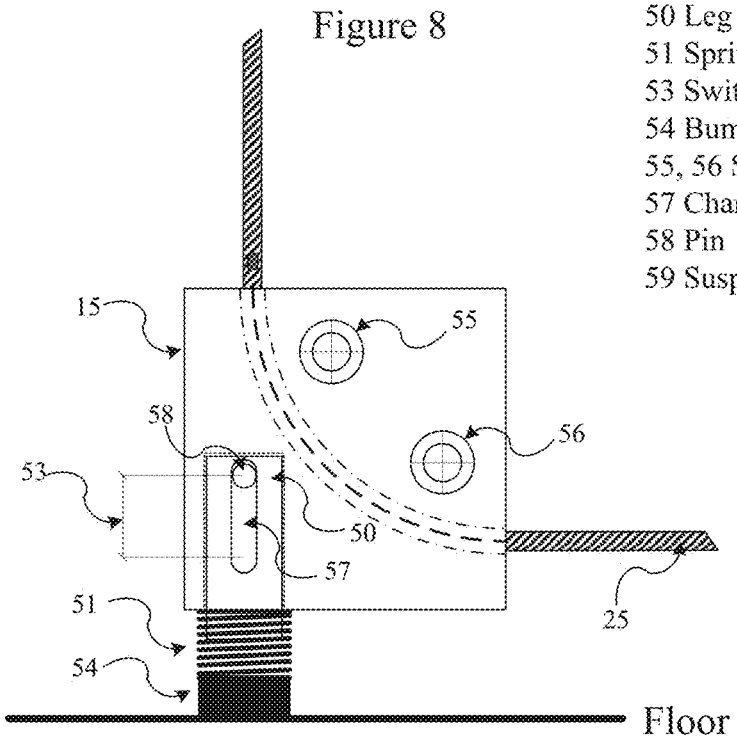
FIG. 9 is a detailed side elevation view of the portion of a storage system shown in FIG. 8.

Systems according to the present invention can include one or more suspensions, such as that seen in FIGS. 8 and 9. A suspension 59 can be attached, for example, to each of the cable benders such as the bender 15. The suspension 59 can include a leg 50, spring 51, and/or bumper 54. The bumper 54 can prevent scratching the ground. When the suspension 59 touches the ground, the spring 51 can begin to compress itself to keep the cables 25,26 in tension. This can make up for incorrect cable lengths. If a cable is too long, it may not be in tension and overlapping of the coiling may be caused without the suspension. If the cable were too short, the frame 10 may be hanging in the air; the suspension 59 can make up for this height difference. A pin 58 can be movable within a channel 57, and can move as shown in FIGS. 8 and 9, such as moving down within the channel with the spring releases (FIG. 8) or up within the channel as the spring compresses (FIG. 9).

Springs according to the present invention can be separate from the cables, such as by being below the platform as opposed to between the cables and the platform as disclosed in U.S. Pat. No. 7,575,098 to Hartley. Springs that are directly installed on a cable must be much more powerful, and thus are more expensive and larger. The spring 51 shown in FIGS. 8 and 9, however, receives much less force, allowing for a cheaper spring. Further, springs attached directly to cables may act differently based on the load, such as not stretching enough with lower loads and stretching too much with higher loads. These springs may also cause sudden spring action or bouncing upon beginning or ending movement. Further, if one side of a device with the springs disclosed by Hartley is loaded more than another, the platform may become tilted; by including spring suspensions below the platform, the platform can always remain parallel to the ground and/or in its designed position.

Figure 10:
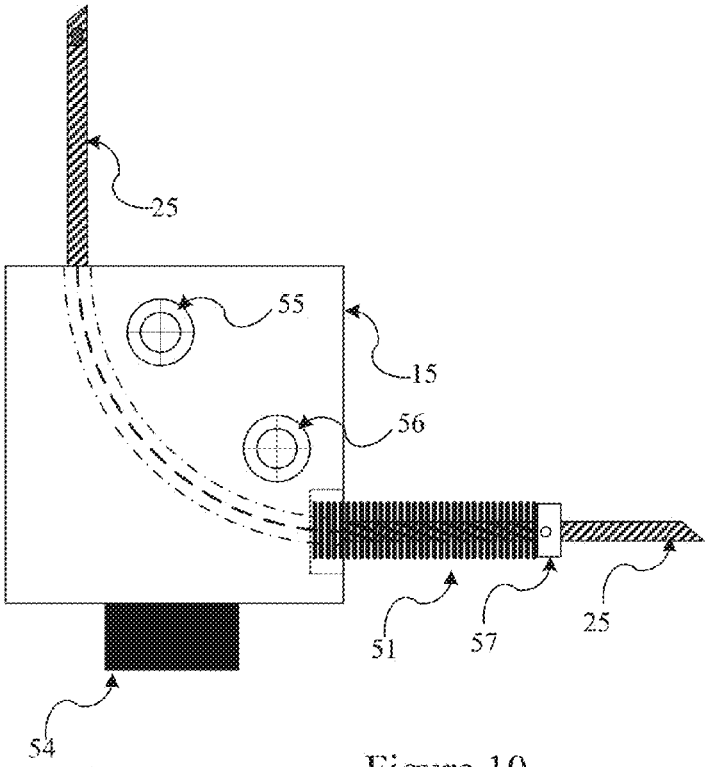
FIG. 10 is a detailed side elevation view of a portion of a storage system according to one embodiment of the present invention.
Figure 11:
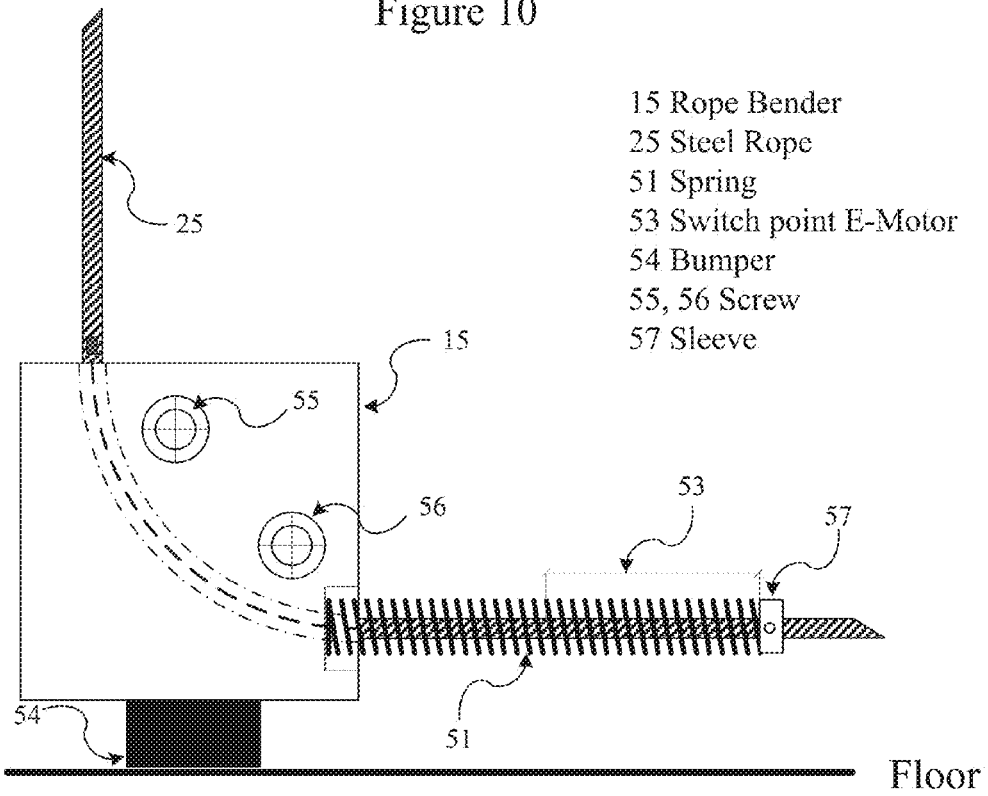
FIG. 11 is a detailed side elevation view of the portion of a storage system shown in FIG. 10.

FIGS. 10 and 11 show another method of prevention loss of tension and/or swinging. A spring 51 can be attached to the side of a cable bender such that the cable passes through the spring, thus allowing a tolerance such that the platform will not swing and the cables will not lose tension.

Figure 18:
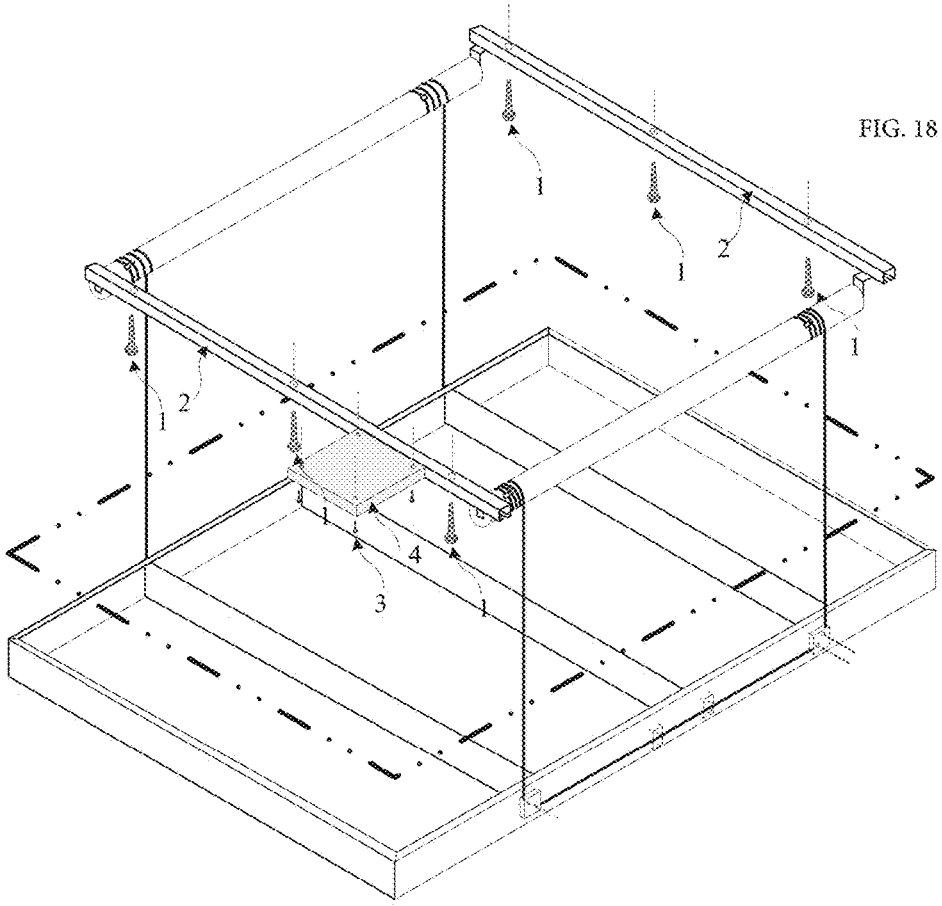
FIG. 18 is a perspective view of a storage system according to the present invention.
Figure 19:
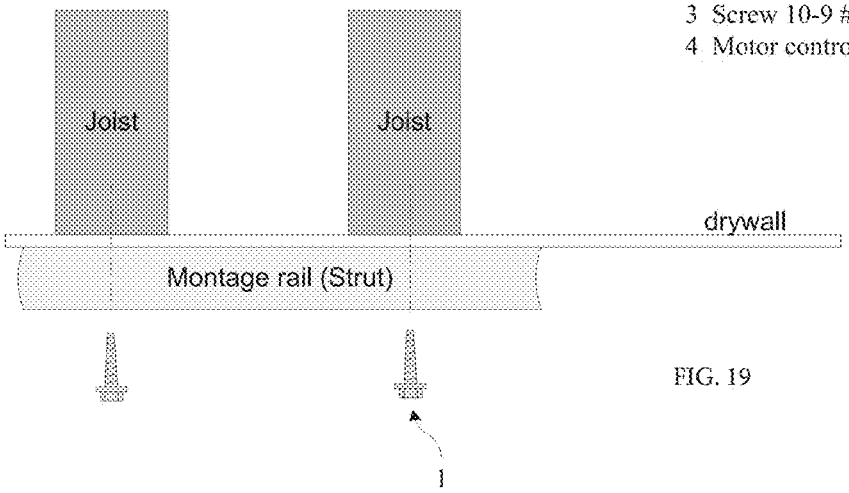
FIG. 19 is a schematic view of a manner in which a storage system according to the present invention can be attached to a ceiling.

FIGS. 18 and 19 show a manner in which a system according to the present invention can be attached to a ceiling. Screws can be placed through a montage rail, through a ceiling, and into one or more joists. Further, screws can also attach the motor controller to the ceiling, although the motor controller can be located in a number of different areas.

In systems according to the present invention using two motors such as the tube motors 27,28, it is important that the motors begin and cease operation simultaneously so that the platform 11 does not become tilted. Interruptions that can potentially cause tilting include overheating, power or cable disconnection, and many other types of interruption. FIGS. 14-17 show circuit diagrams of an electrical system designed to enable simultaneous operation/non-operation of the tube motors 27,28.

Figure 14:
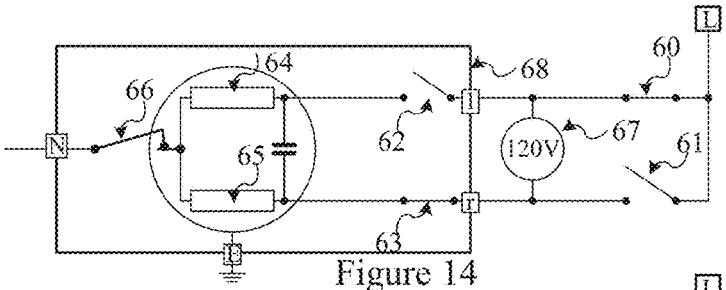
FIG. 14 is a schematic circuit diagram of an electrical system according to one embodiment of the present invention in a first state.

Systems according to the present invention can also include a device for prohibiting the tube motors 27,28 from further movement once the platform reaches a maximum or minimum height. For example, a switch 53 can stop motor operation once this maximum or minimum height is reached, preventing a loss in tension of and/or overlapping of the cables 25,26. When the motors 27,28 reach an endpoint, one of the switches 62,63 can open. For example, when the switch 60 is closed the motor can turn, and when the motor reaches an endpoint (such as the frame 10 or suspension 59 reaching the floor), the switch 62 can open and the motor turn off, as shown in FIG. 14.

Systems according to the present invention can run at many different voltages. The embodiment shown in FIG. 14 runs at 120V. The 120V shown indicates that the temperature switch 66 is closed and there is no overheating of the motors. If one of the motors overheats, the temperature switch 66 can open such that the voltage is reduced to zero because the connection to neutral (N) is interrupted, halting operation.

Figure 15:
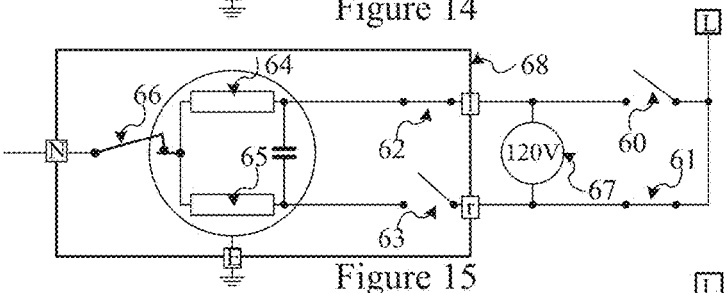
FIG. 15 is a schematic circuit diagram of the electrical system of FIG. 14 in a second state.

FIG. 15 shows a state wherein the switch 61 is closed and the motor turning, and the motor reaches an endpoint such that the switch 63 opens and the motor is turned off. The voltage remains 120V since the temperature switch 66 has not been opened.

Figure 16:
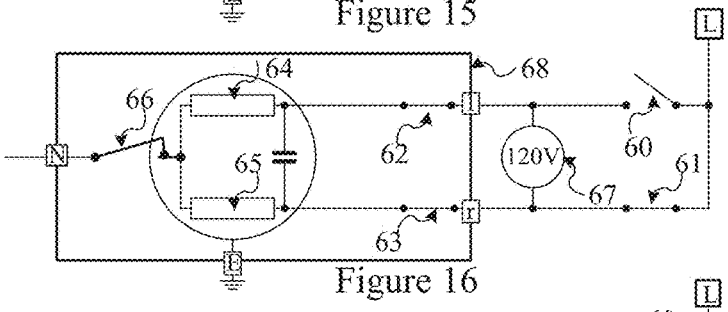
FIG. 16 is a schematic circuit diagram of the electrical system of FIG. 14 in a second state.

In one embodiment, the switches 62,63 are always closed during operation, as shown in FIG. 16. One of the switches 60,61 is closed and the other open, depending upon whether the platform is being raised or lowered. When an endpoint is reached, one of the switches 62,63 will open to cease operation of the motors.

Figure 17:
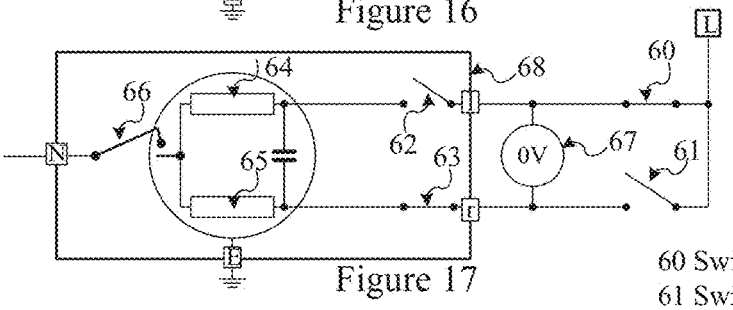
FIG. 17 is a schematic circuit diagram of the electrical system of FIG. 14 in a second state.

FIG. 17 shows a state in which one or more of the motors has overheated. The temperature switch 66 has opened, thus cutting voltage to 0 and ceasing motor operation.

One advantage of operating the motors in this manner is the cost-effectiveness and ease of implementation. The voltage measurement can also control the temperature of the motors even when they are not running when they reached their endpoint, which a current measurement cannot. With this method an overheating, cable disconnection, power loss, etc. can be discovered and the motor turned off.

The electronics for this apparatus' motors can be in the montage rail 23 or 24 or attached to any other part of the apparatus to be less visible or make the design more visually pleasing. The electronics could also be stored, for example, in the ceiling.

Systems according to the present invention can have legs attached to the platform or shelf frame. These legs could be foldable or telescopic, for example. These legs can enable the platform 11 to be used as a table. Cables attached to the platform could be detached and/or unsnapped and coiled so as to be out of the way. The platform surface can be used for different hobbies, crafting, play, projects, etc., and can be "retrievable" so that when a user wishes to return to the project, the platform can be lowered and the user can pick up where he or she left off. The platform 11 can be a wire deck or another surface. The platform 11 could have drawers or other compartments to make it possible to store items in it and have a retrievable work or hobby-bench. Certain embodiments of the invention can be raised or lowered using a wireless remote; the system can include a receiver for receiving a signal to operate the motors from the remote.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

I claim:

1. An overhead storage device, comprising:

a left tube motor;

a right tube motor;

a platform;

a left cable connecting said left tube motor to said platform, said left cable coiling on and around said left tube motor when said left tube motor is rotating in a first direction, and said left cable uncoiling from on said left tube motor when said left tube motor is rotating in a second direction opposite said first direction; and a right cable connecting said right tube motor to said platform, said right cable coiling on and around said right tube motor when said right tube motor is rotating in said second direction, and said right cable uncoiling from on said right tube motor when said right tube motor is rotating in said first direction.

2. The device of claim 1, wherein said left cable is attached to said left tube motor at first and second attachment points and said right cable is attached to said right tube motor at third and fourth attachment points.

3. The device of claim 2, wherein said left cable is configured to coil around said left tube motor in a first direction from each of said first and second attachment points; and wherein said right cable is configured to coil around said right tube motor in a second direction opposite said first direction from each of said third and fourth attachment points.

4. The device of claim 2, wherein said first and second attachments points are proximate opposite ends of said left tube motor and wherein said third and fourth attachment points are proximate opposite ends of said right tube motor.

5. The device of claim 1, wherein said left cable is coiled around said left tube motor and said right cable is coiled around said right tube motor.

6. The device of claim 5, wherein said left cable is coiled around first and second areas of said left tube motor, said first and second areas of said left tube motor proximate opposite ends of said left tube motor; and wherein said right cable is coiled around first and second areas of said right tube motor, said first and second areas of said right tube motor proximate opposite ends of said right tube motor.

7. The device of claim 1, wherein said left cable is attached to said platform at first and second cable benders and said right cable is attached to said platform at third and fourth cable benders.

8. The device of claim 1, further comprising one or more suspensions.

9. The device of claim 8, wherein said suspension is below said platform.

10. The device of claim 8, wherein said suspension comprises a spring.

11. The device of claim 8, wherein a cable bender comprises at least one of said suspensions.

12. The device of claim 1, wherein said left tube motor is configured to rotate in a direction opposite said right tube motor.

13. The device of claim 1, wherein said tube motors are outside a perimeter of said platform.

14. The device of claim 1, wherein said left cable coils around or uncoils from said left tube motor at first and second areas along said left tube motor when said overhead storage device is in operation; and wherein said right cable coils around or uncoils from said right tube motor at first and second areas along said right tube motor when said overhead storage device is in operation.

15. The device of claim 14, wherein said first and second areas along said left tube motor are proximate first and second ends of said left tube motor, respectively; and wherein said first and second areas along said right tube motor are proximate first and second ends of said right tube motor, respectively.

16. The device of claim 1, wherein said left cable and said right cable are ropes.

17. The device of claim 1, wherein said left cable and said right cable are steel ropes.

* * * * *